US008678687B2

(12) United States Patent
Peter

(10) Patent No.: US 8,678,687 B2
(45) Date of Patent: Mar. 25, 2014

(54) METHOD AND DEVICE FOR AUTOMATICALLY ADAPTING A WRITE CYCLE IN A DIGITAL PRINTING MACHINE

(75) Inventor: Karlheinz Peter, Molfsee (DE)

(73) Assignee: Eastman Kodak Company, Rochester, NY (US)

( * ) Notice: Subject to any disclaimer, the term of this patent is extended or adjusted under 35 U.S.C. 154(b) by 93 days.

(21) Appl. No.: 13/406,832

(22) Filed: Feb. 28, 2012

(65) Prior Publication Data

US 2012/0219342 A1 Aug. 30, 2012

(30) Foreign Application Priority Data

Feb. 28, 2011 (DE) ..... 10 2011 012 677
Apr. 15, 2011 (DE) ..... 10 2011 017 209

(51) Int. Cl.

| | |
|---|---|
| ***B41J 13/00*** | (2006.01) |
| ***B41J 15/00*** | (2006.01) |
| ***G03G 15/00*** | (2006.01) |
| ***B65H 23/04*** | (2006.01) |

(52) U.S. Cl.

USPC ..... 400/578; 400/611; 399/389; 399/394; 226/27; 226/28

(58) Field of Classification Search

CPC ..... B41J 11/0035; B41J 11/42; B41J 15/165; G06G 15/6517; G06G 15/6558; G06G 2215/00455

USPC ..... 400/578, 611; 399/389, 394, 396; 226/2, 27, 28

See application file for complete search history.

(56) References Cited

U.S. PATENT DOCUMENTS

| | | | | |
|---|---|---|---|---|
| 7,327,972 | B2 | 2/2008 | Matsuda et al. | |
| 2008/0124158 | A1* | 5/2008 | Folkins | 399/396 |
| 2011/0063355 | A1* | 3/2011 | Eun et al. | 347/16 |

* cited by examiner

*Primary Examiner* — Daniel J Colilla
*Assistant Examiner* — Blake A Tankersley
(74) *Attorney, Agent, or Firm* — Christopher J. White

(57) ABSTRACT

A method for automatically adapting a write cycle to a movement of a web-shaped medium in a digital printing machine, as a function of the thickness of the web-shaped medium guided around first and second transport or guide rollers, includes providing the first and second transport or guide rollers having a known diameters, the diameter of the second being different from the diameter of the first. A rotational speed ratio N(T) between the first and second transport or guide rollers (9, 11) is determined while the printing material (6) is guided around the transport or guide rollers (9, 11). The write cycle is determined at least with the use of the previously determined rotational speed ratio N(T).

12 Claims, 4 Drawing Sheets

METHOD AND DEVICE FOR AUTOMATICALLY ADAPTING A WRITE CYCLE IN A DIGITAL PRINTING MACHINE

CROSS-REFERENCE TO RELATED APPLICATIONS

This application is related to and claims priority of DE 102011012677.5 filed Feb. 28, 2011 and DE 102011017209.2 filed Apr. 15, 2011, which are hereby incorporated herein by reference in their entirety.

FIELD OF THE INVENTION

The present invention relates to a device and a method for automatically adapting a write cycle in a digital printing machine, where a write cycle is adapted to a movement of a web-shaped medium as a function of the thickness of the medium.

BACKGROUND OF THE INVENTION

In printing technology it is known, on the one hand, to print web-shaped printing materials and, on the other hand, to print separated sheet-shaped printing materials. When printing a web-shaped printing material, the printing material, as a rule, is taken off a roll and moved past one or more printing units of a printing machine, wherein a printing medium such as, for example, ink, is applied to the web-shaped printing material.

In digital printing machines, the write cycle—also referred to as the line cycle—required for imaging control has to be adapted with high accuracy to the movement of the printing material web that is moved past a print head of the printing machine. The line cycle, together with the speed of the printing material web, determines the resolution of a printed image in the advance direction of the printing material. To achieve a given resolution and to keep the resolution constant for an entire print job, an exact adjustment between the line cycle and the speed or movement of the printing material web is therefore essential.

Typically, the speed of the printing material web, the speed being the basis of the write cycle, is determined with the aid of a single transport or guide roller or both that is also referred to as the speedometer shaft, and with an encoder that is coupled therewith. Typically, the encoder is configured as a high-resolution incremental encoder that generates equidistant pulses when the speedometer shaft rotates at a constant speed. Based on these pulses and with the exact knowledge of the diameter of the speedometer shaft, the number of bars of the encoder that identifies the number of pulses with one complete rotation of the encoder, and the thickness of the printing material web, it is possible to determine the speed of the printing material and generate a corresponding write cycle. FIG. 2 is a schematic representation of such a configuration.

By the use of a suitable selection of the number of bars of the encoder, the speedometer shaft diameter and the printing material thickness, it is possible, in principle, to adjust to any desired line resolution. In an arrangement as has been described hereinabove, however, the thickness of the web-shaped printing material, as a rule, is not taken into consideration. Printing materials having different thicknesses, however, result in different transport speeds because the thickness of the printing material contributes to the effective radius of the speedometer shaft. If such differences are not taken into consideration in the aforementioned system, inaccuracies result regarding the adjustment between the line cycle and the speed of the printing material when the printing machine is operated with printing materials having different thicknesses. Ultimately this leads to an elongation or compression of an image at the time of imaging because the write cycle is not exactly adjusted to the actual transport speed of the printing material.

Hereinafter, the influence of the thickness of the printing material on the actual web speed of the printing material shall be explained in greater detail.

For a line resolution R, the following applies:

$$R = \frac{E}{\Pi(D_T + T)} \tag{1}$$

wherein E is the number of bars of the encoder, $D_T$ is the diameter of the speedometer shaft and T is the paper thickness (see FIG. 2).

Depending on the selection of the speedometer shaft diameter, the actual line resolution varies by 3‰ to 5‰ over the thickness range relevant to the roll printing machines for printing materials that can be used. In an A3 sheet having a length of 420 mm this corresponds to an absolute length error of 1.2 mm to 2 mm. An error of this order of magnitude is intolerable in high-quality printed products.

In order to solve this technical problem, high-resolution incremental encoders or encoders are frequently used, whereby their output clock rate is scaled via a divider logic to the desired line cycle. The scaling factor required for a specific paper thickness is typically determined by the machine operator by measuring test images and is manually set via a control panel. However, this procedure is time-consuming and labor-intensive, and the result is dependent on the care with which the machine operator is working. Furthermore, this procedure has to be performed for each new roll of printing material and can thus not respond to changes within a roll of printing material.

SUMMARY OF THE INVENTION

According to an aspect of the present invention, there is provided a method for automatically adapting a write cycle to a movement of a web-shaped medium (6) in a digital printing machine (1) during the operation of the machine, as a function of the thickness (T) of the web-shaped medium, where the web-shaped medium (6) is guided around a first transport or guide roller (9) and a second transport or guide roller (11), the method comprising:

providing the first transport or guide roller (9) having a first known diameter (DU) and the second transport or guide roller having a known second diameter (DT), the second diameter being different from the first diameter (DU);

determining a rotational speed ratio N(T) between the first and second transport or guide rollers (9, 11) while the printing material 6) is guided around the transport or guide rollers (9, 11); and determining the write cycle at least with the use of the previously determined rotational speed ratio N(T).

According to an aspect of the present invention, there is provided a device for automatically adapting a write cycle to a movement of a web-shaped medium (6) in a digital printing machine as a function of the thickness of the web-shaped medium (6), the device comprising:

a first transport or guide roller (9) having a known diameter (DU), the roller being connected to a first encoder (20);

a second transport or guide roller (11) having a known second diameter (DT) that is different from the first diameter (DU), the roller being connected to a second encoder (22); and a control unit (27) that is capable of receiving pulses from the first and second encoders (20, 22) and of determining, from the pulses, a ratio of rotational speeds between the first and the second transport or guide rollers during operation, and of performing an adaptation of the write cycle at least with the use of the determined ratio of rotational speeds.

A method and a device are provided for automatically adapting a write cycle of a print head in a printing machine to a transport speed of the printing material taking into consideration the thickness of the printing material.

A method for automatically adapting a write cycle to a movement of a web-shaped medium in a digital printing machine is provided, wherein the adaptation takes place as a function of the thickness of the web-shaped medium. The web-shaped medium is guided around a first and a second transport or guide roller, where the first transport or guide roller has a known first diameter and the second transport or guide roller has a second known diameter, the second diameter is different from the first diameter. The present invention includes the determination of a rotational speed ratio between the first and the second transport or guide rollers, while the printing material is guided around the transport or guide rollers, and the determination of the write cycle at least considering this rotational speed ratio.

Such a method enables the highly accurate adaptation of the write cycle of a print head in a printing machine to the actual speed of the web-shaped medium, which is the printing material in a roll printing machine, because it automatically includes the thickness of the medium in the determination of the write cycle based on the rotational speed ratio. Furthermore it is taken into consideration that, depending on the roller diameter, the printing material thickness has a varying effect on the ratio between the printing material speed and the rotational speed of the roller, so that printing material webs having varying thicknesses generate varying rotational speed ratios.

A method of this type can be employed, in particular in roll printing machines in which the medium is the printing material. However, this method can also be used in different printing machines such as, for example, sheet printing machines, where, on the one hand, the thickness of the printing material, or also the thickness of a conveyor belt that moves the printing material past the printing units, can automatically be taken into consideration. The aforementioned effects, as it were, also occur with transport belts having varying thicknesses. The effect of different transport speeds for transport belts of varying thickness is the same as occurs in a roll printing machine with a web-shaped printing material. Here the thickness of the transport belt is added to the effective radius of a speedometer shaft as well, the shaft is coupled—as in the above-described example—with one of the transport or guide rollers of the transport belt.

In general, the description continues to refer to the web-shaped medium as the printing material web in a roll printing machine. However, regardless of this, the invention also can be applied to a sheet-shaped printing material or to a transport belt in a sheet printing machine.

In order to determine the write cycle, a nominal write cycle can first be determined based on a rotational speed of the second transport or guide roller and on a previously mathematically or experimentally determined scaling factor that is correlated to the thickness of the printing material and that is subsequently adapted taking into consideration the determined rotational speed ratio. This determination can be made mathematically for a known nominal thickness of the web-shaped medium with the knowledge of the diameter of the second transport or guide roller as well as a number of bars of an encoder thereof. However, it is also possible to determine an appropriate scaling factor by the use of a calibration routine, whereby a web-shaped medium having any thickness is printed, for example, at fixed encoder pulses, and the printing result is measured. This determination is particularly robust in regard to any tolerances of paper thickness and the roller diameter.

Preferably, a nominal rotational speed ratio is determined that enters into the determination of the write cycle. The nominal rotational speed ratio can be determined mathematically, taking into consideration a known nominal thickness of the web-shaped medium, the diameter of the first transport or guide roller and the diameter of the second transport or guide roller, or—without the knowledge of the data—can be determined experimentally as part of a calibration routine. For example, the nominal rotational speed ratio can be determined beforehand and the result be stored in a memory so that the nominal rotational speed ratio need not be determined again each time the aforementioned method is performed.

Preferably, for automatically adapting the write cycle during operation, an adaptation value is determined using the nominal rotational speed ratio and the rotational speed ratio determined during operation, the value is disposed to adapt the nominal write cycle. This enables a simple and rapid adaptation to the rotational speed ratios determined during operation in order to be able to automatically respond to changing thicknesses of the printing material in a simple manner.

In one embodiment of the method, first pulses of an encoder that is connected to the first transport or guide roller and second pulses of a second encoder that is connected to the second transport or guide roller are delivered to a counter for the determination of the rotational speed ratio. Each of the second pulses increments the value of the counter, and each of the first pulses sets back the counter. The value of the counter is determined between each two successive pulses of the first encoder and, with the use of the detected values of the counter, a number of bars P1 of the first encoder, as well as a number of bars P2 of the second encoder, the rotational speed ratio is determined. The second encoder should provide a high resolution, in particular a high number of bars, whereas the second encoder can display a low resolution.

Preferably, the number of bars of the second encoder is selected as a function of the diameter of the second transport or guide roller in such a manner that the pulses of the second encoder enable a higher local resolution than the highest desired line resolution of an image that is to be printed.

As opposed to this, the first encoder can, for example, output zero pulses only, where a zero pulse is a pulse that is output after one full rotation, i.e., 360°. Such an encoder can have a simple design and achieve high accuracy. However, the first encoder can also output several signals with one complete rotation of the transport or guide roller, e.g., after each 90°. Advantageously, the pulses should be output equidistantly, and the distance between successive pulses should be known so exactly as to have a determined ratio to the resolution of the second encoder. The use of several pulses during one rotation of the first transport or guide roller can be used for a more rapid adaptation of the write cycle to the actual web speed of the printing web; however, this increases the demands on the first encoder.

In a preferred embodiment of the method, the detected values of the counter can be low-pass-filtered through a sliding mean-value determination. As a result of this, it is additionally possible to filter out inaccuracies of the encoders or of the speedometer shaft or of the transport or guide rollers.

The present invention includes a device for automatically adapting a write cycle to a movement of a web-shaped medium in a digital printing machine that is capable of automatically taking into consideration the thickness of the web-shaped medium for adaptation. The device can, like the method, be implemented in a roll printing machine or in a sheet printing machine. The device includes a first transport or guide roller having a known first diameter, the roller being connected to a first encoder, and includes a second transport or guide roller having a second known diameter, which is different from the first diameter, and is connected to a second encoder. Furthermore, the device includes a control unit that is capable of receiving pulses from the first and the second encoder and to determine therefrom a rotational speed ratio between the first and the second transport or guide rollers during operation, and to perform an adaptation of the write cycle by use of at least the determined rotational speed ratio. Such a device enables an automatic consideration of the thicknesses of a printing material in the determination of a write cycle for the application of images to the printing material.

In one embodiment of the invention the control unit includes a counter with the second encoder connected to an incremental input of the counter and the first encoder connected to a reset input of the counter. With the knowledge of the number of bars of the first and second encoders, such an arrangement enables the simple determination of the rotational speed ratio for adapting the write cycle.

Preferably, the second encoder has a known number of bars that is selected as a function of the thickness of the second transport or guide roller in such a manner that a local resolution higher than the highest desired line resolution of an image to be printed can be achieved.

In a simple design, the first encoder preferably includes a number of bars equal to 1.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
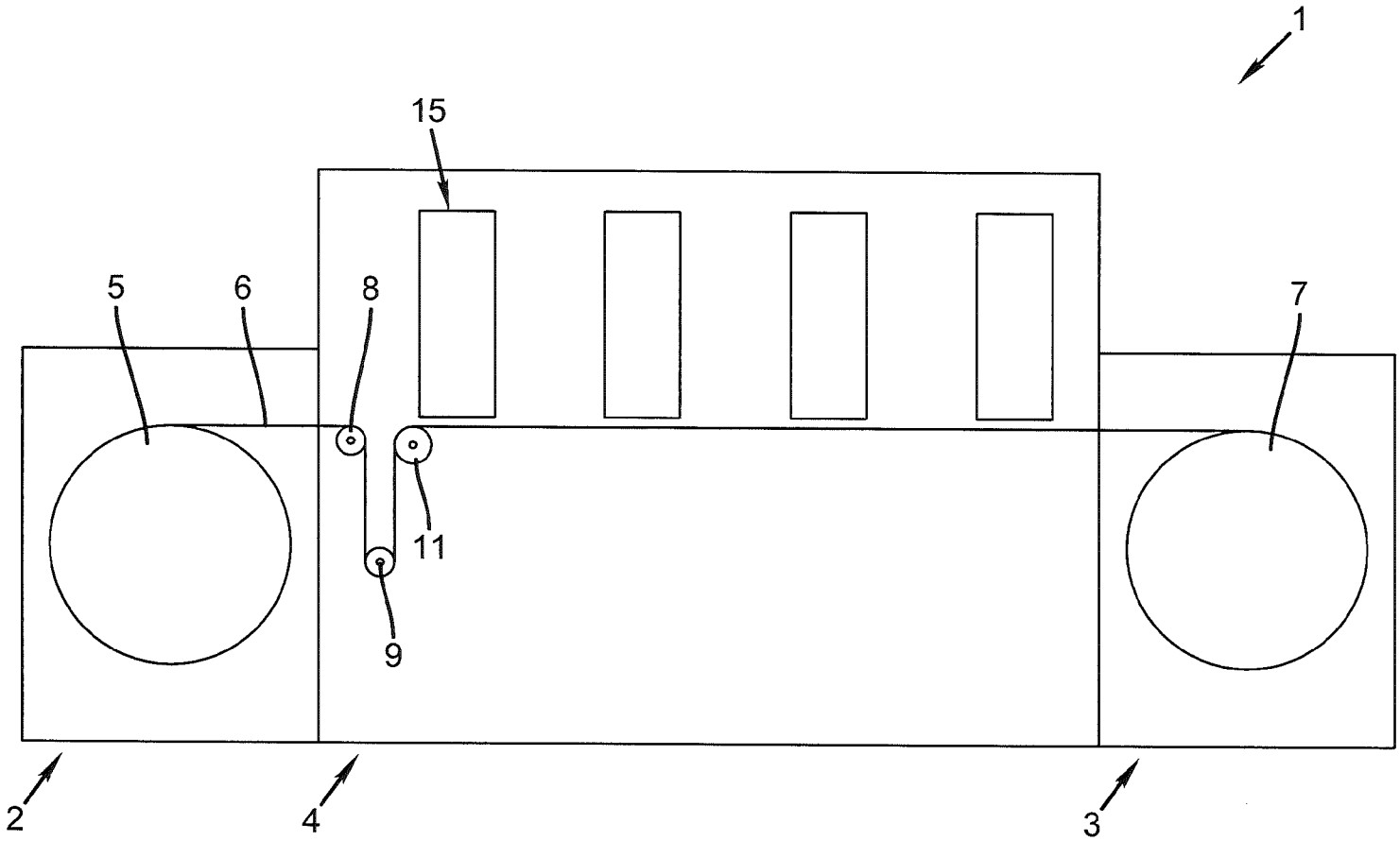
FIG. 1 is a schematic side view of a roll printing machine.

In the description hereinafter, information regarding location or direction primarily relates to the representations in the drawings and should thus not be viewed as restrictive; however, such information can also relate to preferred final arrangements.

FIG. 1 is a schematic side view of a digital printing machine 1 for web-shaped printing materials 6. The printing machine 1 includes an unwinder 2, a winder 3, as well as an interposed printing region 4. A printing material roll 5 is rotatably supported in the unwinder 2, from where the printing material 6 is passed through the printing region 4 to a printing material take-up roll 7 in the winder 3.

During the printing operation, the printing material 6 is conveyed from the printing material roll 5 to the printing material take-up roll 7, i.e., via a plurality of transport or guide rollers 8, 9, 11 in the printing region 4, only three of the rollers are shown to simplify the drawing. Hereinafter, for simplification, such transport or guide rollers 8, 9, 11 will be referred to as rollers. As a rule, a larger number of such rollers that transport and guide the printing material 6 along a non-linear transport path through the printing region 4 are provided.

The printing region 4 includes a plurality of printing units 15. FIG. 1 shows four printing units 15, so that the printing machine 1 as in FIG. 1 would be suitable for four-color printing. However, depending on use, it is also possible to provide a number of printing units 15 that are different therefrom. In a preferred embodiment of the invention, the printing units 15 are ink jet printing units, but they can also be of another type.

Figure 2:
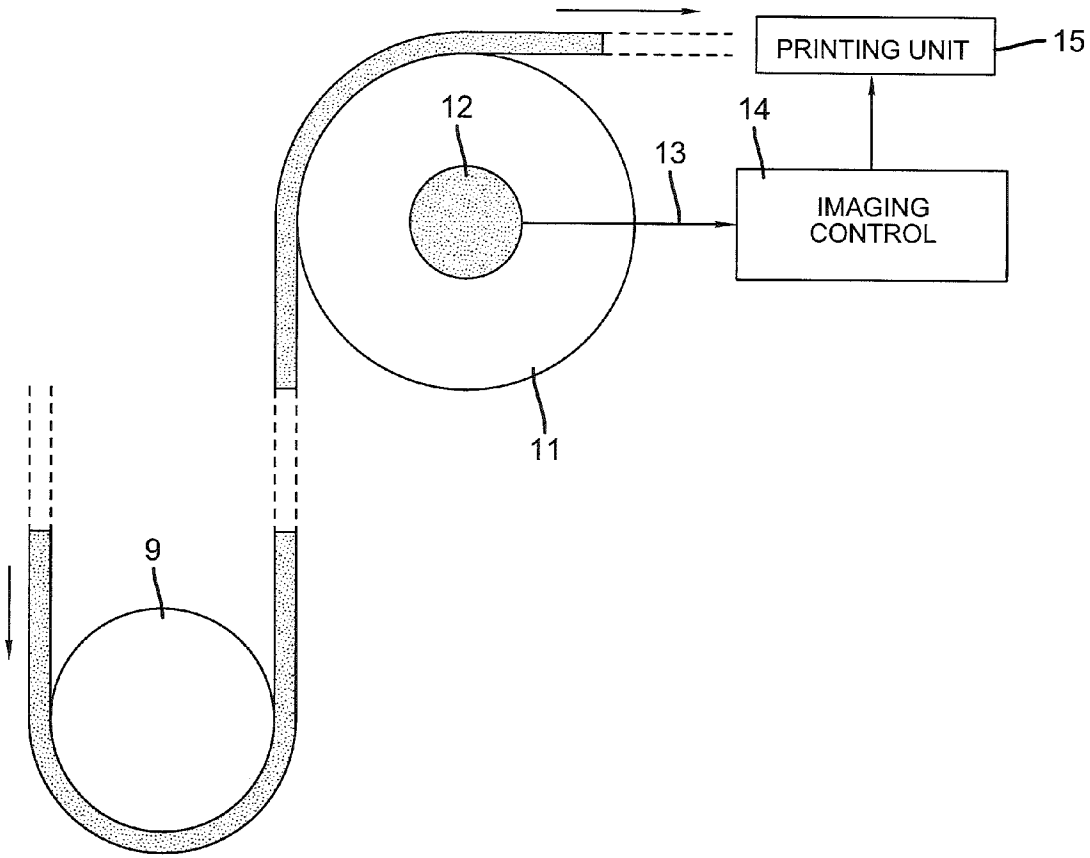
FIG. 2 PRIOR ART
FIG. 2 is a schematic side view of a device for determining the write cycle in a prior-art roll printing machine.

Depending on a speed of the printing material 6, the printing units 15 are activated with a desired write cycle that is also referred to as a line cycle, in order to achieve a specific image resolution in advance direction of the printing material 6. FIG. 2 is a schematic side view of a device for determining the write cycle of a prior-art printing machine 1, as has already been mentioned in the introductory part of the description.

In this device, the rollers 8 and 9—only roller 9 is shown—can be configured as simple guide rollers without additional function. In contrast, the roller 11 is connected to a high-resolution encoder that outputs control pulses 13 to an imaging control 14 during a rotation of the roller 11. In turn, this imaging control activates the printing units 15 with a specific line cycle, taking into consideration the control pulses. However, the device is not capable of automatically responding to the changing thicknesses of the printing material that, as mentioned hereinabove, would require an adaptation of the write cycle.

Figure 3:
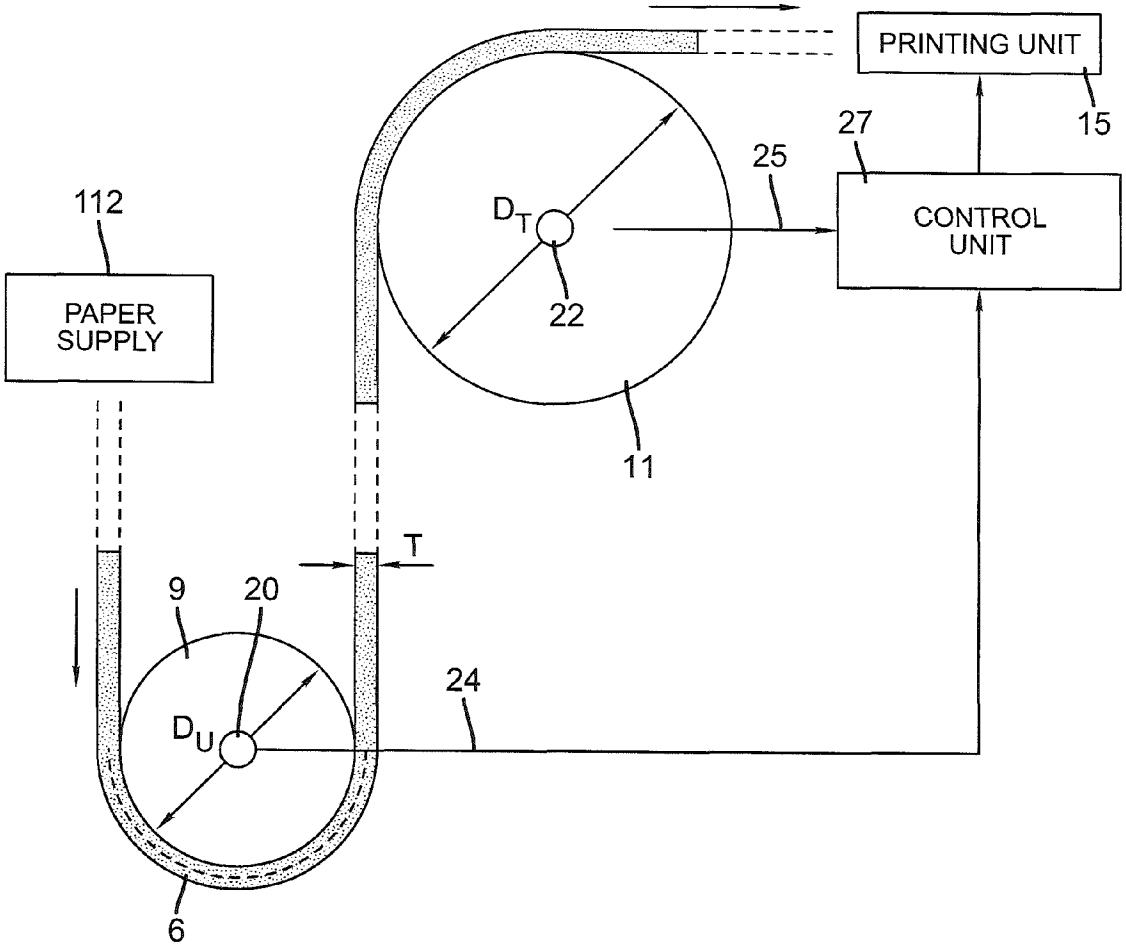
FIG. 3 is a schematic side view of a device for determining or adapting the write cycle in a roll printing machine in accordance with the invention.

FIG. 3 is a schematic side view of a device for determining or adapting the write cycle in a printing machine in accordance with the invention. In this device, the roller 8—not illustrated—can be configured as a simple guide roller without additional function. In contrast, each of the rollers 9 and 11 is connected to an encoder 20 or 22, the encoders delivering control pulses 24 or 25 to a control unit 27 during a rotation of the respective roller 9, 11. In turn, the control unit 27—again taking into consideration the control pulses 24 and 25—activates the printing units 15 with a specific line cycle. The printing material 6 supplied by paper supply 112 sufficiently wraps around the rollers 9, 11, preferably by at least 90°, in order to avoid slippage between the roller and the printing material. Of course, it is also possible to select other wrap angles, provided it has been ensured that no slippage occurs between the roller 9, 11 and the printing material.

Each of the rollers 9 and 11 has a known diameter $D_U$ and $D_T$, respectively, where the diameters are different from each other and their ratio is preferably even-numbered. Due to this configuration, the device is capable of automatically responding to changing thicknesses of the printing material and to perform an adaptation of the write cycle, as will still be explained in greater detail hereinafter.

In the illustration as in FIG. 3, the roller 11 has a greater diameter than the roller 9, although this can also be different. The encoder 20 can be configured as a zero pulse encoder that outputs exactly one control pulse 24 for each full rotation of the roller. Consequently, the encoder has a number of bars equal to 1. However, it is also possible to provide an encoder with a different number of bars.

As opposed to this, the encoder 22 is, preferably, configured as a high-resolution pulse generator that enables a resolution (resulting from the diameter of the roller 11 and the number of bars of the encoder 22) higher than the highest line resolution of an image to be printed (resulting from the speed of the printing material 6 and the line cycle).

In the control unit 27, the control pulses 24, 25 of the encoders 20, 22 are processed and used for adapting the line cycle for the activation of the printing units. In particular, a rotational speed ratio between the rollers 9 and 11 is determined, the ratio is a function of the thickness of the printing material. In conjunction with this, it is taken into consideration that the thickness of the printing material 6 affects the ratio between the printing material speed and the rotational speed of the rollers in varying degrees, depending on the roller diameter, so that printing material webs having different thicknesses generate different rotational speed ratios between the rollers 9, 11. In this way, it is possible to automatically take into consideration the thickness of the printing material 6 during the line cycle determination.

Figure 4:
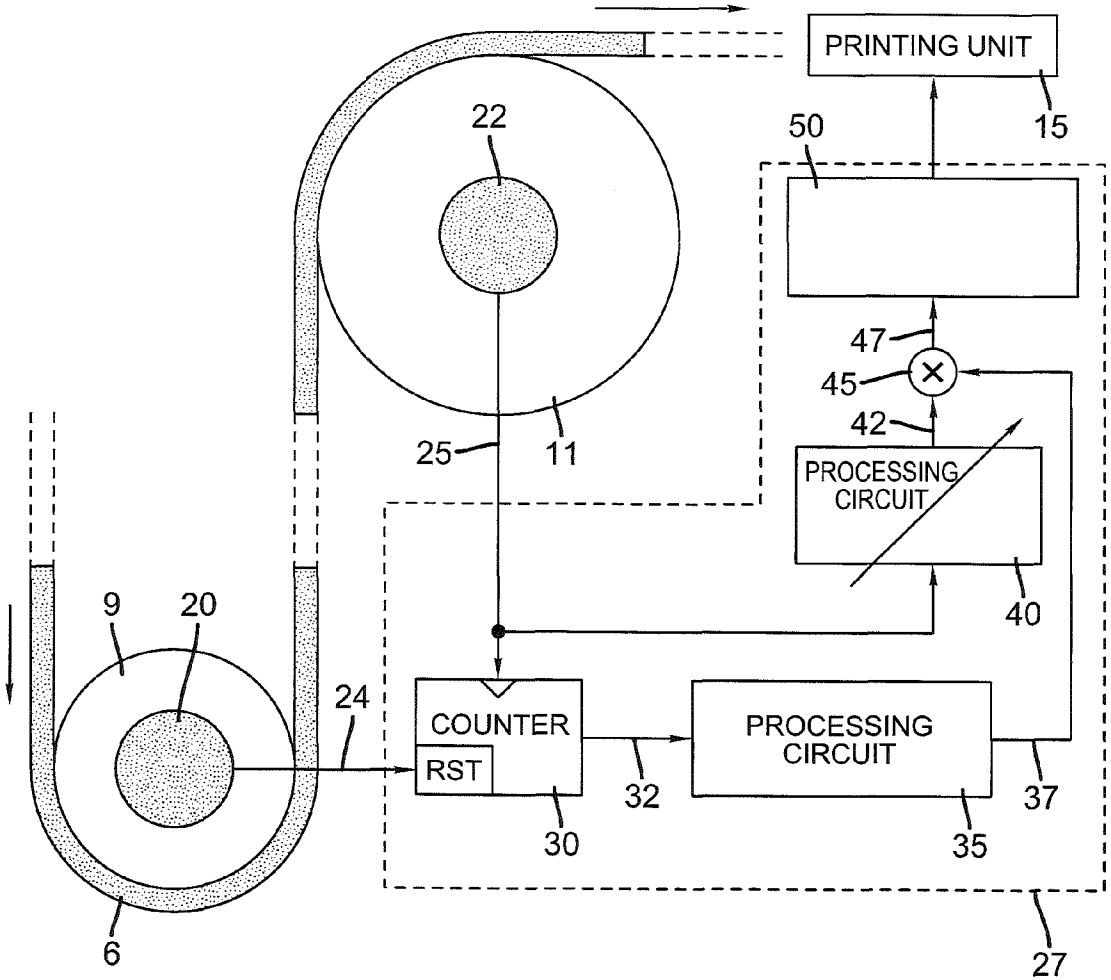
FIG. 4 is a schematic side view, similar to FIG. 3, with a special embodiment of a control unit for determining or adapting the write cycle.

FIG. 4 shows a specific embodiment of the control unit 27 for determining and adapting the line cycle for the activation of the printing units 15. The control unit 27 includes a counter 30, a first processing circuit 35, a second processing circuit 40, a multiplier 45 and an imaging control 50.

The counter 30 includes an increment input that is connected to the encoder 22 and receives control pulses 25 from the encoder, and includes a reset input that is connected to the encoder 20 and receives control pulses 24 from the encoder. Pulses entering the increment input increase the counter status, whereas pulses entering in the reset input reset the counter status to zero. Thus, the counter can count the control pulses 25 between successive control pulses 24, thus enabling the determination of a rotational speed ratio between the rollers 9, 11, with the knowledge of the respective numbers of bars of the encoders 20 and 22. It is obvious to the person skilled in the art that this can also be achieved in another manner. The counter outputs a signal 32 to the first processing circuit 35, the signal corresponding to the respective number of control pulses 25 between successive control pulses 24.

The processing circuit 35 provides low-pass filtering of this signal 32 and calculates therefrom an adaptation value K(T), as will be explained in detail hereinafter. A signal 37 corresponding to the adaptation value K(T) will subsequently be forwarded to the multiplier 45.

The second processing circuit 40 is connected to the encoder 22 and receives the control pulse 25 as the input signal. Taking into consideration a pre-specified scaling factor $K_N$, a nominal line cycle is determined in the processing circuit 40, the line cycle being output as a corresponding signal 42 to a multiplier 45. Among other things, the predetermined scaling factor is based on the diameter of the roller 11, the number of bars of the encoder 22 and a nominal thickness of a printing material 6, as will be explained hereinafter, and is a function of the desired line resolution of an image to be printed.

The multiplier 45 performs a multiplication of the signals 37 and 42 corresponding to the nominal line cycle and the adaptation value K(T) and outputs a signal 47 to the imaging control 50 that corresponds to the line cycle used for the activation of the printing units 15. The adaptation value K(T) should be equal to 1 when a printing material web having the nominal thickness is used and should deviate upward or downward for other thicknesses, so that the signal of the nominal line cycle is expanded or compressed. This adaptation value K(T) can have values between 0.90 and 1.1 for relevant thicknesses of the printing materials, and, in particular, between 0.95 and 1.05, provided the nominal thickness of the printing material was selected to be a mean thickness of the relevant range of thicknesses for the printing material. The exact values are determined by the specific rollers 9, 11, by the specific nominal thickness of the printing material and the relevant range of thicknesses for the printing material, as can be realized by the person skilled in the art.

The signal 47 is used as the line cycle in the imaging control that, in turn, correspondingly activates the printing units 15 with this line cycle and the line data to be printed.

Hereinafter, the mathematical basis and processes for the aforementioned control unit 27 in accordance with FIG. 4 will be explained in detail, discussing first a basic calibration of the system to a predetermined nominal thickness of a printing material. Following such a basic calibration, additional fine adaptation caused by different thicknesses of the printing material to be used can be automatically performed.

For the basic calibration, first, the scaling factor $K_N$ is determined for a thickness $T_N$ of the printing material 6 that can be chosen randomly, where the scaling factor then divides the control pulse 25 in the form of a clock rate of the high-resolution encoder 22 down to a desired line resolution. In a first variant, this determination can be performed mathematically. This is done, for example, by performing the following equation (3):

$$R_N = \frac{K_N E}{\Pi(D_T + T_N)} = \frac{E^*}{\Pi(D_T + T_N)}, \tag{2}$$

wherein $R_N$ is the desired line resolution, $K_N$ the scaling factor to be determined, E the prespecified number of bars of the encoder 22, $D_T$ the diameter of the roller 11 and $T_N$ the selected nominal thickness of the printing material. E* represents the product of the scaling factor $K_N$ and the number of lines E. The equation can be solved for $K_N$ without difficulty because the other elements have been predetermined by the system or by the desired line resolution.

However, alternatively, it is also possible to determine a scaling factor as part of a calibration routine, regardless of the exact diameter of the roller 11 and of a thickness of the printing material 6. To accomplish this it is, for example, possible to print a printing material 6 having any thickness $T_{unknown}$, with, for example, a fixed line cycle (respectively corresponding to i pulses of the encoder, wherein i can be a predetermined natural whole number). The corresponding printing image is measured and scaled to the desired line resolution in order to determine the desired scaling factor $K_N$. Such a determination is particularly robust in regard to the tolerances of the roller diameter or the thickness of the printing material.

For any other paper thickness T, this scaling factor would result in a deviating line resolution $$R(T) = \frac{E^*}{\Pi(D_T + T)} \tag{3}$$

wherein R(T) is a line resolution that deviates from the one that is desired, and T is a thickness of the printing material 6, the thickness deviating from the nominal thickness (or an unknown thickness). By use of an adaptation value K(T), which depends on the paper thickness, the value R(T) is now to be adapted to the desired resolution $R_N$. The adaptation value K(T) results from solving the equations (2) and (3) for E* and from subsequently equating the solved equations to obtain the equation (4):

$$R_N = \frac{(D_T + T)}{\underbrace{(D_T + T_N)}_{K(T)}} R(T) \tag{4}$$

In the next step, the printing material thicknesses T and $T_N$ are to be substituted by automatically measurable values in order to enable a printing material thickness adaptation without operator interaction. To accomplish this, use is made of the fact that the printing material thickness affects the ratio between the printing material speed and the rotational speed of the rollers to varying degrees, depending on the roller diameter. Basically, the speed of the printing material web 6 is linked by way of the equation (5)

$$v_B = \Pi(D_T + T) f_T = \Pi(D_U + T) f_U \tag{5}$$

with the rotation frequencies of the roller 11, $f_T$, and the roller 9, $f_U$, wherein $D_U$ describes the diameter of the roller 9.

For the nominal printing material thickness $T_N$ (or also for the unknown printing material thickness $T_{unknown}$), for which the basic calibration was performed, this results in a rotational speed ratio between the speedometer shaft and the deflecting roller of $$N_N = \frac{f_T(N)}{f_U(N)} = \frac{(D_U + T_N)}{(D_T + T_N)}, \tag{6}$$

wherein $N_N$ represents the nominal rotational speed ratio.

For any other printing material thickness, the following applies correspondingly:

$$N(T) = \frac{(D_U + T)}{(D_T + T)} \tag{7}$$

The solutions of the equations (6) and (7) for the paper thicknesses T and $T_N$ produce $$T_N = \frac{N_N D_T - D_U}{(1 - N_N)} \tag{8}$$

and $$T = \frac{N(T) D_T - D_U}{(1 - N(T))} \tag{9}$$

The use of the equations (8) and (9) in equation (4) leads to $$K(T) = \frac{(D_T + T)}{(D_T + T_N)} = \frac{\left(D_T + \frac{N(T) D_T - D_U}{(1 - N(T))}\right)}{\left(D_T + \frac{N_N D_T - D_U}{(1 - N_N)}\right)} = \frac{(1 - N_N)}{(1 - N(T))} * \frac{(D_T - N(T) D_T + N(T) D_T - D_U)}{(D_T - N_N D_T + N_N D_T - D_U)} \tag{10}$$

-continued $$= \frac{(1 - N_N)}{(1 - N(T))}$$

Inasmuch as $N_N$ is known from the system and the nominal thickness of the printing material, only the rotational speed ratio N(T) of the operation has to be detected automatically. To accomplish this, it is, for example, possible as described hereinabove to connect the encoder 20 of the roller 9 to a reset input of the counter 30, while the encoder 22 of the roller 11 is connected to an incremental input of the counter 30.

The counter 30 continuously detects the number of pulses of the control pulse 25 of the encoder 22 between successive pulses of the control pulse 24 of the encoder 20 and forwards corresponding counter states to the processing circuit 35. These counter states can be, for example, first low-pass-filtered by a sliding mean-value determination. When the number of bars of the two encoders 20 and 22 is known, now, during operation, a rotational speed ratio N(T) is a function of the thickness of the printing material and can be determined in accordance with the equation (11):

$$N(T) = \frac{P_2}{P_1 X(T)} \tag{11}$$

wherein P1 is the number of bars of the encoder 20, P2 is the number of bars of the encoder 22 and X(T) is the counter status between successive pulses of the encoder 20. In the preferred case when the encoder 20 is a zero pulse generator with a number of bars equal to 1, the following applies:

$$N(T) = \frac{P}{X(T)}, \tag{12}$$

wherein, in this case, P is equal to the number of bars of the encoder 22.

By inserting this value in equation (10), the sought adaptation value or also the correction factor K(T) is finally obtained and is then multiplied with the line cycle signal 42 in the multiplier 45 in order to maintain the line resolution at the desired value $R_N$. When $N_N$=N(T), which should be the case when a printing material having the nominal thickness is used, the adaptation value is equal to 1 because, at this point in time, the line cycle signal 42 would result in a desired line resolution.

The mathematical explanation above relates to the specifically illustrated embodiment that shows only one way of implementing the basic principle of the invention. The basic principle is based on the use of two rollers 9, 11, each having known but different diameters, with the printing material 6 (a web-shaped medium) is guided around the rollers in order to enable a thickness-dependent speed determination using the rotational speed ratio between the rollers. Instead of the separate determination of the scaling factor $K_N$ and the adaptation value K(T), it is possible, for example, to deposit factors for different rotational speed ratios N(T) in a look-up table as part of a calibration routine, so the rotational speed ratios can be directly applied to the pulse signal of the encoder 22 in order to determine the line cycle signal.

The invention was described with the use of specific embodiments throughout; however, it is not restricted to the specifically represented embodiments. In particular, it is possible to interchange the features of any embodiment with features of another embodiment, or to exchange specific features with others, provided compatibility exists. In particular, the principles above are also applicable to sheet printing machines, where, as mentioned above, thickness variations of transport belts or of sheet-shaped printing materials can be taken into consideration.

The invention has been described with reference to a preferred embodiment. However, it will be appreciated that variations and modifications can be effected by a person of ordinary skill in the art without departing from the scope of the invention.

| PARTS LIST: | |
|---|---|
| 1 | digital printing machine |
| 2 | unwinder |
| 3 | winder |
| 4 | printing region |
| 5 | printing material roll |
| 6 | printing material |
| 7 | printing material take-up roll |
| 8, 9, 11 | transport or guide roller |
| 13 | control pulses |
| 14 | imaging control |
| 15 | printing unit |
| 20 | encoder |
| 22 | encoder |
| 24 | control pulse |
| 25 | control pulse |
| 27 | control unit |
| 30 | counter |
| 32 | signal |
| 35 | processing circuit |
| 37 | signal |
| 40 | processing circuit |
| 42 | line cycle signal |
| 45 | multiplier |
| 47 | signal |
| 50 | imaging control |
| 112 | paper supply |
| $D_T$, $D_U$ | roller diameter |
| T | printing-material thickness |

The invention claimed is:

1. Method for automatically adapting a write cycle to a movement of a web-shaped medium in a digital printing machine during operation of the machine, as a function of a thickness (T) of the web-shaped medium, the method comprising:

providing a first transport or guide roller having a first known diameter ($D_U$) and a second transport or guide roller having a known second diameter ($D_T$), the second diameter being different from the first diameter ($D_U$) wherein the web-shaped medium (6) is guided around the first transport or guide roller and the second transport or guide roller;

determining a rotational speed ratio N(T) between the first and the second transport or guide rollers while the web-shaped medium is guided around the transport or guide rollers; and determining the write cycle at least with the use of the previously determined rotational speed ratio N(T).

2. The method according to claim 1, wherein, the write-cycle-determining step includes first determining a nominal write cycle based on a rotational speed of the second transport or guide roller and on a previously mathematically- or experimentally-determined scaling factor $K_N$ that correlates to a nominal thickness of the printing material, and subsequently adapting the nominal write cycle using the determined rotational speed ratio N(T).

3. The method according to claim 1, further including determining a nominal rotational speed ratio $N_N$ and using the determined ratio in the determination of the write cycle, namely mathematically, using a known nominal thickness of the web-shaped medium, the diameter ($D_U$) of the first transport or guide roller and the diameter ($D_T$) of the second transport or guide roller.

4. The method according to claim 3, further including, during operation, determining an adaptation value K(T) using the nominal rotational speed ratio ($N_N$) and the determined rotational speed ratio N(T), and adapting the nominal write cycle using the adaptation value.

5. The method according to claim 1, wherein the rotational-speed-ratio determining step includes:

delivering to a counter the first pulses of a first encoder that is connected to the first transport or guide roller and the second pulses of a second encoder that is connected to the second transport or guide roller, each of the second pulses incrementing the value of the counter and the first pulses resetting the counter;

determining the value of the counter between each two successive pulses of the first encoder; and using the detected values of the counter, a number of bars P1 of the first encoder, and a number of bars P2 of the second encoder to determine the rotational speed ratio N(T).

6. The method according to claim 5, wherein the number of bars P2 of the second encoder is selected as a function of the diameter of the second transport or guide roller so that the pulses of the second encoder enable a higher local resolution than a highest desired line resolution of an image that is to be printed.

7. The method according to claim 6, further including low-pass-filtering the detected values of the counter through a sliding mean-value determination.

8. The method according to claim 5, further including low-pass-filtering the detected values of the counter through a sliding mean-value determination.

9. A device for automatically adapting a write cycle to a movement of a web-shaped medium in a digital printing machine as a function of a thickness of the web-shaped medium, the device comprising:

a first transport or guide roller having a known first diameter ($D_U$), the transport or guide roller being connected to a first encoder;

a second transport or guide roller having a known second diameter ($D_T$) that is different from the first diameter ($D_U$), the roller being connected to a second encoder, the web-shaped medium being guided around the first and second transport or guide rollers; and a control unit that is capable of receiving pulses from the first and the second encoders and of determining, from the pulses, a ratio of rotational speeds between the first and the second transport or guide rollers during operation, and of performing an adaptation of the write cycle at least with the use of the determined ratio of rotational speeds.

10. The device according to claim 9, wherein the control device includes a counter, the second encoder is connected to the incremental input of the counter, and the first encoder is connected to a reset input of the counter.

11. The device according to claim 9, wherein the second encoder has a number of bars that is selected as a function of the diameter of the second transport or guide roller in such a manner that a local resolution higher than the highest desired line resolution of an image to be printed can be achieved.

12. The device according to claim 9, wherein the first encoder has a number of bars equal to 1.

* * * * *